US009444127B2

(12) United States Patent
Katabuchi et al.

(10) Patent No.: US 9,444,127 B2
(45) Date of Patent: Sep. 13, 2016

(54) DIRECTIONAL COUPLER

(71) Applicant: Murata Manufacturing Co., Ltd., Kyoto (JP)

(72) Inventors: Keisuke Katabuchi, Kyoto (JP); Tetsuo Taniguchi, Kyoto (JP); Yasushi Yunoki, Kyoto (JP)

(73) Assignee: MURATA MANUFACTURING CO., LTD., Kyoto (JP)

( * ) Notice: Subject to any disclaimer, the term of this patent is extended or adjusted under 35 U.S.C. 154(b) by 0 days.

(21) Appl. No.: 14/795,217

(22) Filed: Jul. 9, 2015

(65) Prior Publication Data

US 2016/0028144 A1 Jan. 28, 2016

(30) Foreign Application Priority Data

Jul. 23, 2014 (JP) ..... 2014-149704

(51) Int. Cl.
*H01P 5/18* (2006.01)
*H01P 3/08* (2006.01)

(52) U.S. Cl.
CPC ..... *H01P 5/184* (2013.01); *H01P 5/187* (2013.01)

(58) Field of Classification Search
CPC ..... H01P 5/18; H01P 5/184
USPC ..... 333/109–112, 116
See application file for complete search history.

(56) References Cited

U.S. PATENT DOCUMENTS 4,264,881 A * 4/1981 De Ronde ..... H01P 7/082 331/107 SL
5,841,328 A 11/1998 Hayashi
7,253,701 B2 * 8/2007 Smith ..... H01P 1/2135 333/100
8,044,749 B1 10/2011 Witas
9,331,372 B2 * 5/2016 Fackelmeier ..... H01P 5/18
2016/0028145 A1 * 1/2016 Katabuchi ..... H01P 5/184 333/116

FOREIGN PATENT DOCUMENTS

JP 3203253 B2 8/2001

* cited by examiner

*Primary Examiner* — Dean Takaoka
(74) *Attorney, Agent, or Firm* — Pearne & Gordon LLP

(57) ABSTRACT

A directional coupler includes a main line, a sub line, and a parasitic element. The main line includes first and second main line portions formed substantially in a spiral shape, as viewed from a first direction. The second main line portion is positioned in a second direction which is perpendicular to the first direction, as viewed from the first direction. The sub line includes first and second sub line portions formed substantially in a spiral shape, as viewed from the first direction. The first and second sub line portions are electromagnetically coupled with the first and second main line portions, respectively. The second sub line portion is positioned in the second direction, as viewed from the first direction. The parasitic element is superposed on the first main line portion and the second sub line portion, as viewed from the first direction.

14 Claims, 8 Drawing Sheets

DIRECTIONAL COUPLER

BACKGROUND OF THE DISCLOSURE

1. Field of the Disclosure

The present disclosure relates to a directional coupler, and more particularly, to a directional coupler including a main line and a sub line electromagnetically coupled with each other.

2. Description of the Related Art

As an example of directional couplers of the related art, the directional coupler disclosed in Japanese Patent No. 3203253 is known. This directional coupler includes first and second coupling lines formed in a spiral shape. The first and second coupling lines are superposed on each other in the vertical (top-bottom) direction and are electromagnetically coupled with each other. With this configuration, the first coupling line serves as a main line, while the second coupling line serves as a sub line.

In the directional coupler disclosed in this publication, it is desired that the degree of coupling between the first coupling line (main line) and the second coupling line (sub line) be increased.

BRIEF SUMMARY OF THE DISCLOSURE

Accordingly, it is an object of the present disclosure to provide a directional coupler in which the degree of coupling between a main line and a sub line can be increased.

According to preferred embodiments of the present disclosure, there is provided a directional coupler including a main line, a sub line, and a parasitic element. The main line includes first and second main line portions formed substantially in a spiral shape, as viewed from a first direction. The second main line portion is positioned in a second direction which is perpendicular to the first direction, as viewed from the first direction. The sub line includes first and second sub line portions formed substantially in a spiral shape, as viewed from the first direction. The first and second sub line portions are electromagnetically coupled with the first and second main line portions, respectively. The second sub line portion is positioned in the second direction, as viewed from the first direction. The parasitic element is superposed on the first main line portion and the second sub line portion, as viewed from the first direction.

According to the preferred embodiments of the present disclosure, it is possible to increase the degree of coupling between a main line and a sub line of a directional coupler.

Other features, elements, characteristics and advantages of the present disclosure will become more apparent from the following detailed description of the preferred embodiments of the present disclosure with reference to the attached drawings.

DETAILED DESCRIPTION OF THE DISCLOSURE

First Embodiment

Figure 1:
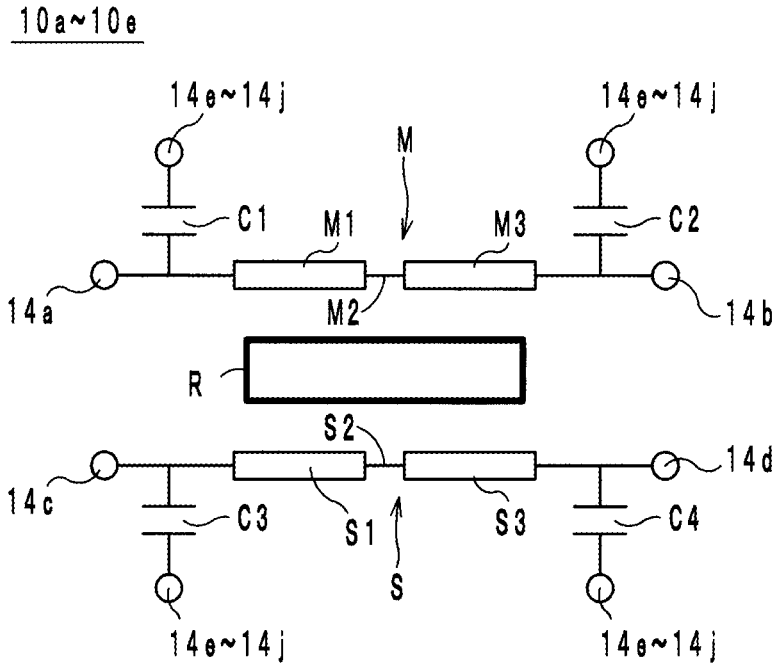
FIG. 1 is an equivalent circuit diagram of a directional coupler.

A directional coupler 10*a* according to a first embodiment will be described below with reference to FIGS. 1 through 4. FIG. 1 is an equivalent circuit diagram of each of directional couplers 10*a* through 10*e*.

The circuit configuration of the directional coupler 10*a* will be described. The directional coupler 10*a* is used in a predetermined frequency band, for example, a frequency band (for example, 698 to 3800 MHz) in which long term evolution (LTE) is used.

As the circuit configuration, the directional coupler 10*a* includes outer electrodes 14*a* through 14*j*, a main line M, a sub line S, capacitors C1 through C4, and a ring conductor R. The main line M is connected between the outer electrodes 14*a* and 14*b* and includes main line portions M1 and M3 and an intermediate line portion M2. The main line portion M1, the intermediate line portion M2, and the main line portion M3 are connected in series with each other in this order between the outer electrodes 14*a* and 14*b*.

The sub line S is connected between the outer electrodes 14*c* and 14*d* and includes sub line portions S1 and S3 and an intermediate line portion S2. The sub line portion S1, the intermediate line portion S2, and the sub line portion S3 are connected in series with each other in this order between the outer electrodes 14*c* and 14*d*.

The main line portion M1 and the sub line portion S1 are electromagnetically coupled with each other. The main line portion M3 and the sub line portion S3 are also electromagnetically coupled with each other.

The capacitor C1 is connected between the outer electrode 14*a* and the outer electrodes 14*e* through 14*j*. The capacitor C2 is connected between the outer electrode 14*b* and the outer electrodes 14*e* through 14*j*. The capacitor C3 is connected between the outer electrode 14*c* and the outer electrodes 14*e* through 14*j*. The capacitor C4 is connected between the outer electrode 14*d* and the outer electrodes 14*e* through 14*j*.

The ring conductor R is a ring-shaped conductor layer and is superposed on the main line portions M1 and M3 and the sub line portions S1 and S3. Since the ring conductor R is a parasitic element, the potential of the ring conductor R is stray potential. The ring conductor R is disposed between the main line portion M1 and the sub line portion S1 and between the main line portion M3 and the sub line portion S3. With this configuration, the ring conductor R serves to increase the degree of coupling between the main line M and the sub line S.

In the directional coupler 10*a* configured as described above, the outer electrode 14*a* is used as an input port, while the outer electrode 14*b* is used as an output port. The outer electrode 14*c* is used as a coupling port. The outer electrode 14*d* is used as a terminate port which is terminated at about 50Ω. The outer electrodes 14*e* through 14*j* are used as ground ports which are grounded. When a high-frequency signal is input into the outer electrode 14*a*, it is output from the outer electrode 14*b*. Since the main line M and the sub line S are electromagnetically coupled with each other, a high-frequency signal having a power proportional to the power of a high-frequency signal output from the outer electrode 14*b* is output from the outer electrode 14*c*.

Figure 2:
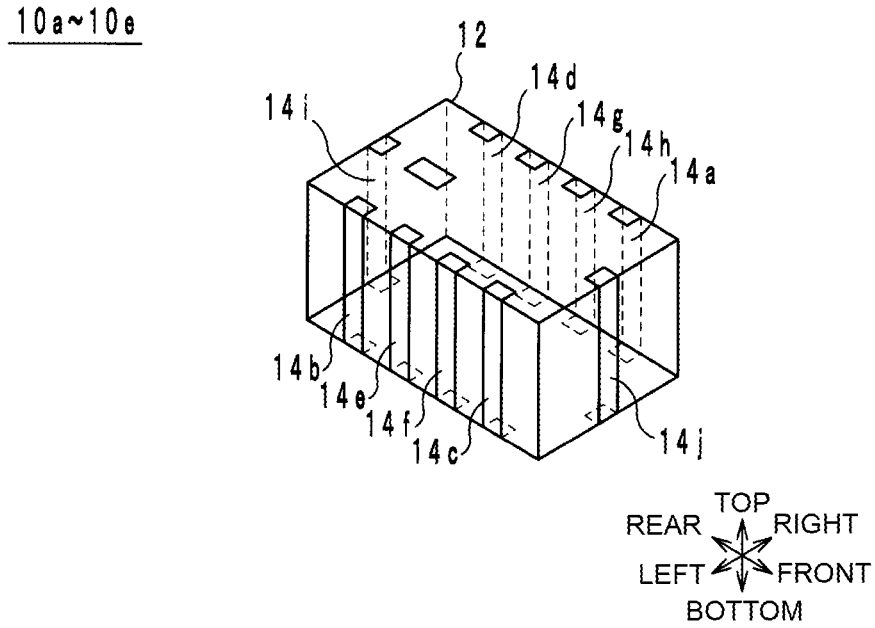
FIG. 2 is an external perspective view of a directional coupler.
Figure 3:
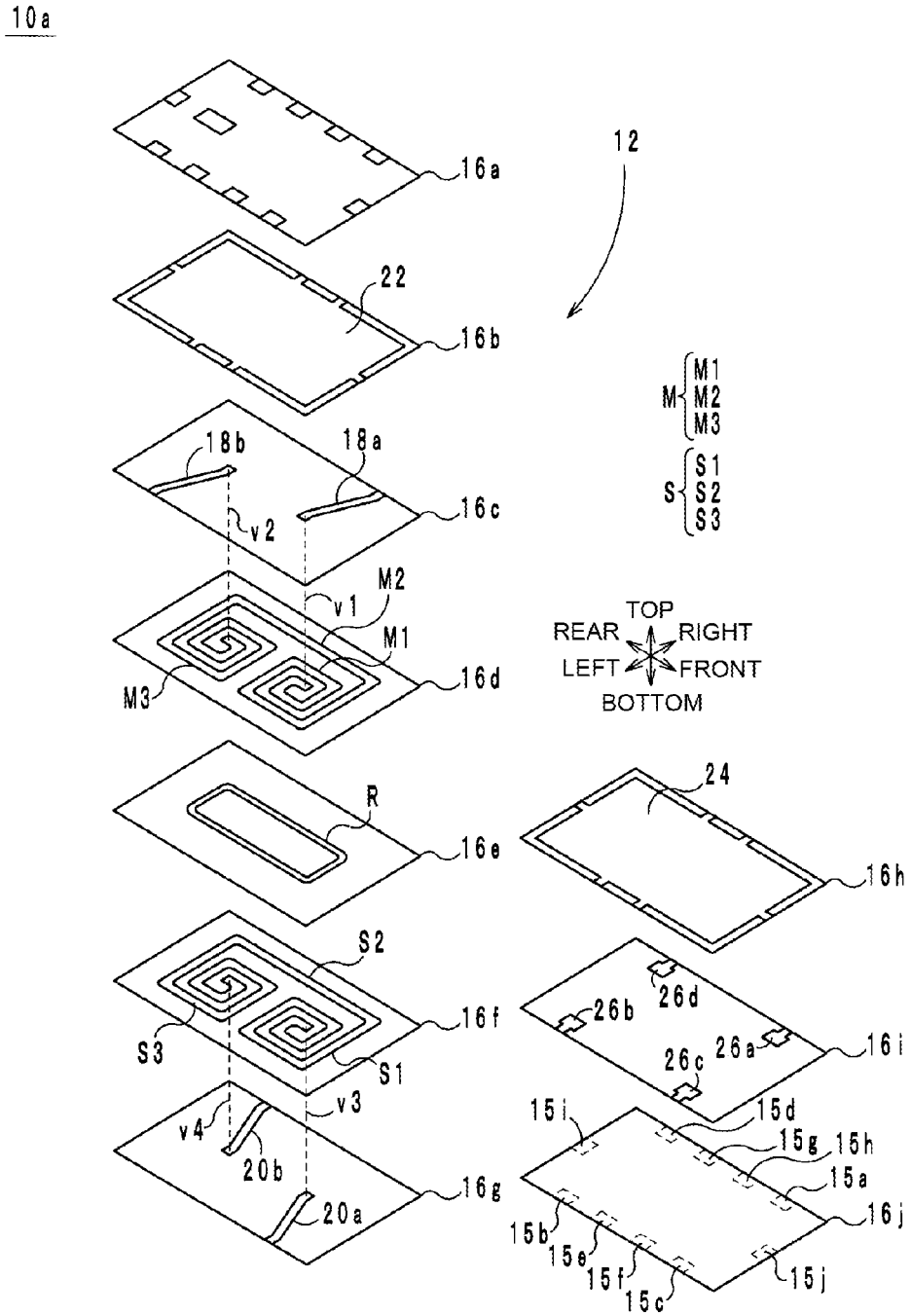
FIG. 3 is an exploded perspective view of a multilayer body of a directional coupler according to a first embodiment.

An example of the specific configuration of the directional coupler 10*a* according to the first embodiment will be discussed below with reference to FIGS. 2 and 3. FIG. 2 is an external perspective view of each of the directional couplers 10*a* through 10*e*. FIG. 3 is an exploded perspective view of a multilayer body 12 of the directional coupler 10*a*. Hereinafter, the stacking direction of the multilayer body 12 is defined as the top-bottom direction, the longitudinal direction of the directional coupler 10*a*, as viewed from above, is defined as the front-rear direction, and the width-wise direction of the directional coupler 10*a*, as viewed from above, is defined as the right-left direction.

As shown in FIGS. 2 and 3, the directional coupler 10*a* includes a multilayer body 12, outer electrodes 14*a* through 14*j*, a main line M, a sub line S, a ring conductor R, extended conductors 18*a*, 18*b*, 20*a*, and 20*b*, ground conductors 22 and 24, capacitor conductors 26*a* through 26*d*, and via-hole conductors v1 through v4.

The multilayer body 12 is formed substantially in a rectangular parallelepiped, as shown in FIG. 2, and is formed by stacking substantially rectangular dielectric layers 16*a* through 16*j* made of dielectric ceramic on each other from the top to the bottom in this order, as shown in FIG. 3. Hereinafter, the top and bottom principal surfaces of the multilayer body 12 will be respectively referred to as the "top surface" and the "bottom surface", the front and rear end surfaces of the multilayer body 12 will be respectively referred to as the "front surface" and the "rear surface", and the right and left side surfaces of the multilayer body 12 will be respectively referred to as the "right surface" and the "left surface". When the directional coupler 10*a* is mounted on a circuit board, the bottom surface of the multilayer body 12 is used as a mount surface opposing the circuit board. The top surfaces of the dielectric layers 16*a* through 16*j* will be referred to as the "front sides", and the bottom surfaces of the dielectric layers 16*a* through 16*j* will be referred to as the "back sides".

The outer electrodes 14*b*, 14*e*, 14*f*, and 14*c* are disposed on the left surface of the multilayer body 12 from the rear to the front in this order. The outer electrodes 14*b*, 14*e*, 14*f*, and 14*c* extend on the left surface in the top-bottom direction and also bend to the top and bottom surfaces.

The outer electrodes 14*d*, 14*g*, 14*h*, and 14*a* are disposed on the right surface of the multilayer body 12 from the rear to the front in this order. The outer electrodes 14*d*, 14*g*, 14*h*, and 14*a* extend on the right surface in the top-bottom direction and also bend to the top and bottom surfaces.

The outer electrode 14*i* extends on the rear surface of the multilayer body 12 in the top-bottom direction and also bends to the top and bottom surfaces. The outer electrode 14*j* extends on the front surface of the multilayer body 12 in the top-bottom direction and also bends to the top and bottom surfaces.

The main line M is disposed within the multilayer body 12 and includes main line portions M1 and M3 and an intermediate line portion M2. The main line portion M1 is a linear conductor layer disposed on the front half of the front side of the dielectric layer 16*d*. The main line portion M1 is a spiral conductor layer which winds counterclockwise through multiple turns from the start point positioned at the center of the front half of the dielectric layer 16*d* to the terminate point positioned near the right front corner of the dielectric layer 16*d*, as viewed from above. Hereinafter, the start point and the terminate point of the main line portion M1 will be respectively referred to as the "upstream end" and the "downstream end". The center of the main line portion M1 is the upstream end of the main line portion M1. Accordingly, the main line portion M1 is formed in a spiral shape moving farther away from the center point while winding around the center point counterclockwise.

The main line portion M3 is a linear conductor layer disposed on the rear half of the front side of the dielectric layer 16*d*. Accordingly, the main line portion M3 is disposed at the rear of the main line portion M1, as viewed from above. The main line portion M3 is a spiral conductor layer which winds counterclockwise through multiple turns from the start point positioned near the right rear corner of the dielectric layer 16*d* to the terminate point positioned at the center of the rear half of the dielectric layer 16*d*, as viewed from above. Hereinafter, the start point and the terminate point of the main line portion M3 will be respectively referred to as the "upstream end" and the "downstream end". The center of the main line portion M3 is the downstream end of the main line portion M3. Accordingly, the main line portion M3 is formed in a spiral shape moving closer to the center point while winding around the center point counterclockwise.

The main line portions M1 and M3 configured as described above are line-symmetrical with each other about a straight line passing through the center of the dielectric layer 16*d* and extending in the right-left direction.

The intermediate line portion M2 is a linear conductor layer disposed on the front side of the dielectric layer 16*d*. The intermediate line portion M2 connects the downstream end of the main line portion M1 and the upstream end of the main line portion M3 and extends along the right long side of the dielectric layer 16*d*. That is, the intermediate line portion M2 is connected between the first and third main line portions M1 and M3. Accordingly, the main line portions M1 and M3 are electrically connected in series with each other. The main line portions M1 and M3 and the intermediate line portion M2 are formed by applying a conductive paste made of a metal, that is, Cu or Ag, as the main component to the front side of the dielectric layer 16*d*.

The extended conductor 18*a* is a straight linear conductor layer disposed on a higher level than the main line M in the top-bottom direction, and more specifically, on the front side of the dielectric layer 16*c*. One end portion of the extended conductor 18*a* is superposed on the upstream end of the main line portion M1, as viewed from above. The other end portion of the extended conductor 18*a* extends to the right long side of the dielectric layer 16*c* and is connected to the outer electrode 14*a*.

The via-hole conductor v1 passes through the dielectric layer 16*c* in the top-bottom direction and connects the end portion of the extended conductor 18*a* superposed on the upstream end of the main line portion M1 and the upstream end of the main line portion M1.

The extended conductor 18*b* is a straight linear conductor layer disposed on a higher level than the main line M in the top-bottom direction, and more specifically, on the front side of the dielectric layer 16*c*. One end portion of the extended conductor 18*b* is superposed on the downstream end of the main line portion M3, as viewed from above. The other end portion of the extended conductor 18*b* extends to the left long side of the dielectric layer 16*c* and is connected to the outer electrode 14*b*.

The extended conductor 18*b* has substantially the same configuration as the extended conductor 18*a*. More specifically, if the extended conductor 18*b* is rotated by 180° around the center of the dielectric layer 16*c*, it coincides with the extended conductor 18*a*. That is, the extended conductors 18*a* and 18*b* are point-symmetrical with each other about the center of the dielectric layer 16*c*.

The via-hole conductor v2 passes through the dielectric layer 16*c* in the top-bottom direction and connects the end portion of the extended conductor 18*b* superposed on the downstream end of the main line portion M3 and the downstream end of the main line portion M3. With this configuration, the main line M is connected between the outer electrodes 14*a* and 14*b*. The via-hole conductors v1 and v2 are formed by charging a conductive paste made of a metal, that is, Cu or Ag, as the main component into via-holes formed in the dielectric layer 16*c*.

The sub line S is disposed within the multilayer body 12 and includes sub line portions S1 and S3 and an intermediate line portion S2. The sub line S has substantially the same configuration as the main line M, and the sub line S and the main line M are superposed on each other and coincides with each other, as viewed from above.

The sub line portion S1 is a linear conductor layer disposed on the front half of the front side of the dielectric layer 16*f*. The sub line portion S1 is a spiral conductor layer which winds counterclockwise through multiple turns from the start point positioned at the center of the front half of the dielectric layer 16*f* to the terminate point positioned near the right front corner of the dielectric layer 16*f*, as viewed from above. Hereinafter, the start point and the terminate point of the sub line portion S1 will be respectively referred to as the "upstream end" and the "downstream end". The center of the sub line portion S1 is the upstream end of the sub line portion S1. Accordingly, the sub line portion S1 is formed in a spiral shape moving farther away from the center point while winding around the center point counterclockwise.

The sub line portion S3 is a linear conductor layer disposed on the rear half of the front side of the dielectric layer 16*f*. Accordingly, the sub line portion S3 is disposed at the rear of the sub line portion S1, as viewed from above. The sub line portion S3 is a spiral conductor layer which winds counterclockwise through multiple turns from the start point positioned near the right rear corner of the dielectric layer 16*f* to the terminate point positioned at the center of the rear half of the dielectric layer 16*f*, as viewed from above. Hereinafter, the start point and the terminate point of the sub line portion S3 will be respectively referred to as the "upstream end" and the "downstream end". The center of the sub line portion S3 is the downstream end of the sub line portion S3. Accordingly, the sub line portion S3 is formed in a spiral shape moving closer to the center point while winding around the center point counterclockwise.

The sub line portions S1 and S3 configured as described above are line-symmetrical with each other about a straight line passing through the center of the dielectric layer 16*f* and extending in the right-left direction.

The intermediate line portion S2 is a linear conductor layer disposed on the front side of the dielectric layer 16*f*. The intermediate line portion S2 connects the downstream end of the sub line portion S1 and the upstream end of the sub line portion S3 and extends along the right long side of the dielectric layer 16*f*. That is, the intermediate line portion S2 is connected between the first and third sub line portions S1 and S3. Accordingly, the sub line portions S1 and S3 are electrically connected in series with each other. The sub line portions S1 and S3 and the intermediate line portion S2 are formed by applying a conductive paste made of a metal, that is, Cu or Ag, as the main component to the front side of the dielectric layer 16*f*.

The extended conductor 20*a* is a straight linear conductor layer disposed on a lower level than the sub line S in the top-bottom direction, and more specifically, on the front side of the dielectric layer 16*g*. One end portion of the extended conductor 20*a* is superposed on the upstream end of the sub line portion S1, as viewed from above. The other end portion of the extended conductor 20*a* extends to the left long side of the dielectric layer 16*g* and is connected to the outer electrode 14*c*. The extended conductor 20*a* has substantially the same length as the extended conductor 18*a*.

The via-hole conductor v3 passes through the dielectric layer 16*f* in the top-bottom direction and connects the end portion of the extended conductor 20*a* superposed on the upstream end of the sub line portion S1 and the upstream end of the sub line portion S1.

The extended conductor 20*b* is a straight linear conductor layer disposed on a lower level than the sub line S in the top-bottom direction, and more specifically, on the front side of the dielectric layer 16*g*. One end portion of the extended conductor 20*b* is superposed on the downstream end of the sub line portion S3, as viewed from above. The other end portion of the extended conductor 20*b* extends to the right long side of the dielectric layer 16*g* and is connected to the outer electrode 14*d*. The extended conductor 20*b* has substantially the same length as the extended conductor 18*b*.

The extended conductor 20*b* has substantially the same configuration as the extended conductor 20*a*. More specifically, if the extended conductor 20*b* is rotated by 180° around the center of the dielectric layer 16*g*, it coincides with the extended conductor 20*a*. That is, the extended conductors 20*a* and 20*b* are point-symmetrical with each other about the center of the dielectric layer 16*g*. The extended conductors 18*a*, 18*b*, 20*a*, and 20*b* are formed by applying a conductive paste made of a metal, that is, Cu or Ag, as the main component to the front sides of the dielectric layers 16*c* and 16*g*.

The via-hole conductor v4 passes through the dielectric layer 16*f* in the top-bottom direction and connects the end portion of the extended conductor 20*b* superposed on the downstream end of the sub line portion S3 and the downstream end of the sub line portion S3. With this configuration, the sub line S is connected between the outer electrodes 14*c* and 14*d*. The via-hole conductors v3 and v4 are formed by charging a conductive paste made of a metal, that is, Cu or Ag, as the main component into via-holes formed in the dielectric layer 16*f*.

The ring conductor R is disposed on the dielectric layer 16*e*, and is a conductor layer formed substantially in a ring-like shape, as viewed from above. The ring conductor R is superposed on the main line portions M1 and M3 and the sub line portions S1 and S3. In the first embodiment, the ring conductor R is formed substantially in a rectangle longitudinally extending in the front-rear direction, as viewed from above. The centers of the main line portions M1 and M3 and the centers of the sub line portions S1 and S3 are positioned within the region surrounded by the ring conductor R, as viewed from above. Since the ring conductor R is a parasitic element, it is not connected to other conductors. The ring conductor R is disposed between the main line portion M1 and the sub line portion S1 and between the main line portion M3 and the sub line portion S3 in the top-bottom direction.

The ground conductor 22 is disposed within the multilayer body 12, and is located on a higher level than the main line M, the sub line S, the ring conductor R, and the extended conductors 18*a*, 18*b*, 20*a*, and 20*b* in the top-bottom direction. More specifically, the ground conductor 22 is formed substantially in a rectangular shape and is disposed such that it covers substantially the entire surface of the front side of the dielectric layer 16*b*. The ground conductor 22 extends to the individual sides of the dielectric layer 16*b* and is connected to the outer electrodes 14*e* through 14*j*.

The ground conductor 24 is disposed within the multilayer body 12 and is located on a lower level than the main line M, the sub line S, the ring conductor R, and the extended conductors 18*a*, 18*b*, 20*a*, and 20*b* in the top-bottom direction. More specifically, the ground conductor 24 is formed substantially in a rectangular shape and is disposed such that it covers substantially the entire surface of the front side of the dielectric layer 16*h*. The ground conductor 24 extends to the individual sides of the dielectric layer 16*h* and is connected to the outer electrodes 14*e* through 14*j*. The ground conductors 22 and 24 are formed by applying a conductive paste made of a metal, that is, Cu or Ag, as the main component to the front sides of the dielectric layers 16*b* and 16*h*, respectively.

The capacitor conductors 26*a* through 26*d* are disposed within the multilayer body 12 and are located on a lower level than the ground conductor 24 in the top-bottom direction. More specifically, the capacitor conductors 26*a* through 26*d* are substantially rectangular conductor layers disposed on the front side of the dielectric layer 16*i*. The capacitor conductor 26*a* extends to the right long side of the dielectric layer 16*i* and is connected to the outer electrode 14*a*. The capacitor conductor 26*a* opposes the ground conductor 24 with the dielectric layer 16*h* therebetween so as to form a capacitor C1. With this configuration, the capacitor C1 is connected between the outer electrode 14*a* and the outer electrodes 14*e* through 14*j*.

The capacitor conductor 26*b* extends to the left long side of the dielectric layer 16*i* and is connected to the outer electrode 14*b*. The capacitor conductor 26*b* opposes the ground conductor 24 with the dielectric layer 16*h* therebetween so as to form a capacitor C2. With this configuration, the capacitor C2 is connected between the outer electrode 14*b* and the outer electrodes 14*e* through 14*j*.

The capacitor conductor 26*c* extends to the left long side of the dielectric layer 16*i* and is connected to the outer electrode 14*c*. The capacitor conductor 26*c* opposes the ground conductor 24 with the dielectric layer 16*h* therebetween so as to form a capacitor C3. With this configuration, the capacitor C3 is connected between the outer electrode 14*c* and the outer electrodes 14*e* through 14*j*.

The capacitor conductor 26*d* extends to the right long side of the dielectric layer 16*i* and is connected to the outer electrode 14*d*. The capacitor conductor 26*d* opposes the ground conductor 24 with the dielectric layer 16*h* therebetween so as to form a capacitor C4. With this configuration, the capacitor C4 is connected between the outer electrode 14*d* and the outer electrodes 14*e* through 14*j*. The capacitor conductors 26*a* through 26*d* are formed by applying a conductive paste made of a metal, that is, Cu or Ag, as the main component to the front side of the dielectric layer 16*i*.

Advantages

By the use of the directional coupler 10*a* configured as described above, it is possible to increase the degree of coupling between the main line M and the sub line S. This will be discussed more specifically. The directional coupler 10*a* includes the ring conductor R. The ring conductor R is superposed on the main line portions M1 and M3 and the sub line portions S1 and S3, as viewed from above. With this configuration, a capacitor is formed between the main line portion M1 and the sub line portion S1 via the ring conductor R, and a capacitor is formed between the main line portion M3 and the sub line portion S3 via the ring conductor R. That is, capacitors are formed between the main line M and the sub line S. As a result, the capacitive coupling between the main line M and the sub line S is enhanced, thereby increasing the degree of coupling between the main line M and the sub line S.

In the directional coupler 10*a*, the centers of the main line portions M1 and M3 and the centers of the sub line portions S1 and S3 are located within the region surrounded by the ring conductor R, as viewed from above. With this configuration, it is possible to reduce the amount of magnetic flux generated by the main line portions M1 and M3 and the sub line portions S1 and S3 that is blocked by the ring conductor R.

The inventors of this application conducted the following computer simulations to verify the advantages obtained by the directional coupler 10*a*. The inventors fabricated, as a first model, a directional coupler obtained by removing the ring conductor R from the directional coupler 10*a*. The inventors also fabricated the directional coupler 10*a* as a second model. Then, the coupling characteristics and the isolation characteristics of the first and second models were calculated by using a computer. The coupling characteristics are represented by the ratio of the power of a high-frequency signal output from the outer electrode 14*c* (coupling port) to the power of a high-frequency signal input from the outer electrode 14*a* (input port). The isolation characteristics are represented by the ratio of the power of a high-frequency signal output from the outer electrode 14*d* (terminate port) to the power of a high-frequency signal output from the outer electrode 14*a* (input port). Then, the present inventors calculated a value by dividing the value of the isolation characteristics by the value of the coupling characteristics, as the degree of coupling.

Figure 4:
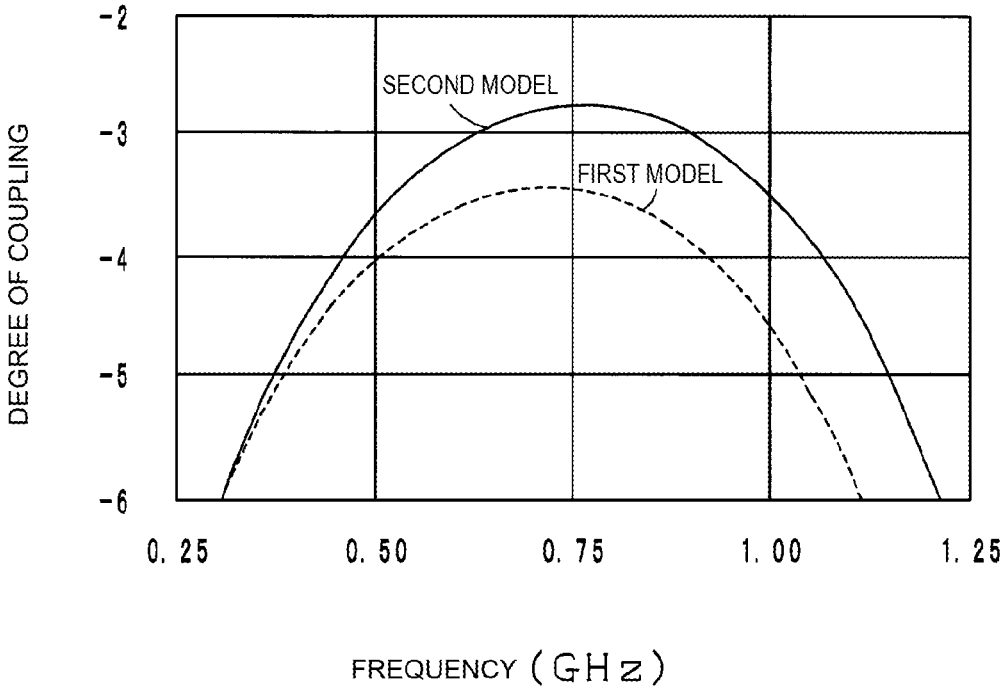
FIG. 4 is a graph illustrating simulation results of a first model and a second model.

FIG. 4 is a graph illustrating the simulation results of the first model and the second model. In FIG. 4, the vertical axis indicates the degree of coupling (dB), and the horizontal axis indicates the frequency (GHz). In FIG. 4, as the vertical scale increases, the degree of coupling is higher, and as the vertical scale decreases, the degree of coupling is lower.

FIG. 4 shows that the degree of coupling of the second model is higher than that of the first model. It has thus been validated that, by the provision of the ring conductor R in the directional coupler 10*a*, the degree of coupling between the main line M and the sub line S is increased.

The main line M and the sub line S have substantially the same configuration, and are superposed on each other and coincide with each other, as viewed from above. Accordingly, the structure of the main line M and that of the sub line S are similar to each other, and thus, the electrical characteristics, such as the characteristic impedance, of the main line M and those of the sub line S can resemble each other. This makes it possible to reduce the phase difference between a signal output from the outer electrode 14*b* and a signal output from the outer electrode 14*c*. That is, the phase difference characteristics of the directional coupler 10*a* are enhanced.

Since the extended conductors 18*a* and 20*a* have substantially the same length, the resistance and phase change of the extended conductor 18*a* and those of the extended conductor 20*a* are substantially equal to each other. Accordingly, the electrical characteristics, such as the characteristic impedance, between the outer electrodes 14*a* and 14*b* and those between the outer electrodes 14*c* and 14*d* can resemble each other. The phase difference characteristics of the directional coupler 10*a* are also enhanced. The relationships between the extended conductors 18*b* and 20*b* can be explained in a similar manner, and thus, similar advantages can be obtained.

The extended conductors 18*a*, 18*b*, 20*a*, and 20*b* are formed in a linear shape. Accordingly, they can be connected to the outer electrodes with the shortest distance. Thus, the resistance of the extended conductors 18*a*, 18*b*, 20*a*, and 20*b* can be reduced to a small level, thereby suppressing unwanted magnetic coupling or capacitive coupling. As a result, the insertion loss of the directional coupler 10*a* can be reduced.

In the directional coupler 10*a*, the capacitor C1 is disposed between the outer electrode 14*a* and the outer electrodes 14*e* through 14*j*, the capacitor C2 is disposed between the outer electrode 14*b* and the outer electrodes 14*e* through 14*j*, the capacitor C3 is disposed between the outer electrode 14*c* and the outer electrodes 14*e* through 14*j*, and the capacitor C4 is disposed between the outer electrode 14*d* and the outer electrodes 14*e* through 14*j*. With this configuration, by changing the capacitance values of the capacitors C1 through C4, the characteristic impedance between the outer electrodes 14*a* and 14*b* and that between the outer electrodes 14*c* and 14*d* can be adjusted. Thus, the characteristic impedance between the outer electrodes 14*a* and 14*b* and that between the outer electrodes 14*c* and 14*d* can resemble each other, thereby enhancing the phase difference characteristics of the directional coupler 10*a*.

The ground conductor 22 is located on a higher level than the main line M, the sub line S, and the extended conductors 18*a*, 18*b*, 20*a*, and 20*b*. With this arrangement, the noise input from the top side of the directional coupler 10*a* can be absorbed by the ground conductor 22, thereby reducing the input and output of the noise into and from the main line M, the sub line S, and the extended conductors 18*a*, 18*b*, 20*a*, and 20*b*.

The ground conductor 24 is located on a lower level than the main line M, the sub line S, and the extended conductors 18*a*, 18*b*, 20*a*, and 20*b*. With this arrangement, the noise input from the bottom side of the directional coupler 10*a* can be absorbed by the ground conductor 24, thereby reducing the input and output of the noise into and from the main line M, the sub line S, and the extended conductors 18*a*, 18*b*, 20*a*, and 20*b*.

The ground conductor 24 is also disposed between the capacitor conductors 26*a* through 26*d* and the main line M, the sub line S, and the extended conductors 18*a*, 18*b*, 20*a*, and 20*b*. This makes it possible to suppress the formation of an unwanted capacitor between the capacitor conductors 26*a* through 26*d* and the main line M, the sub line S, and the extended conductors 18*a*, 18*b*, 20*a*, and 20*b*.

Second Embodiment

Figure 5:
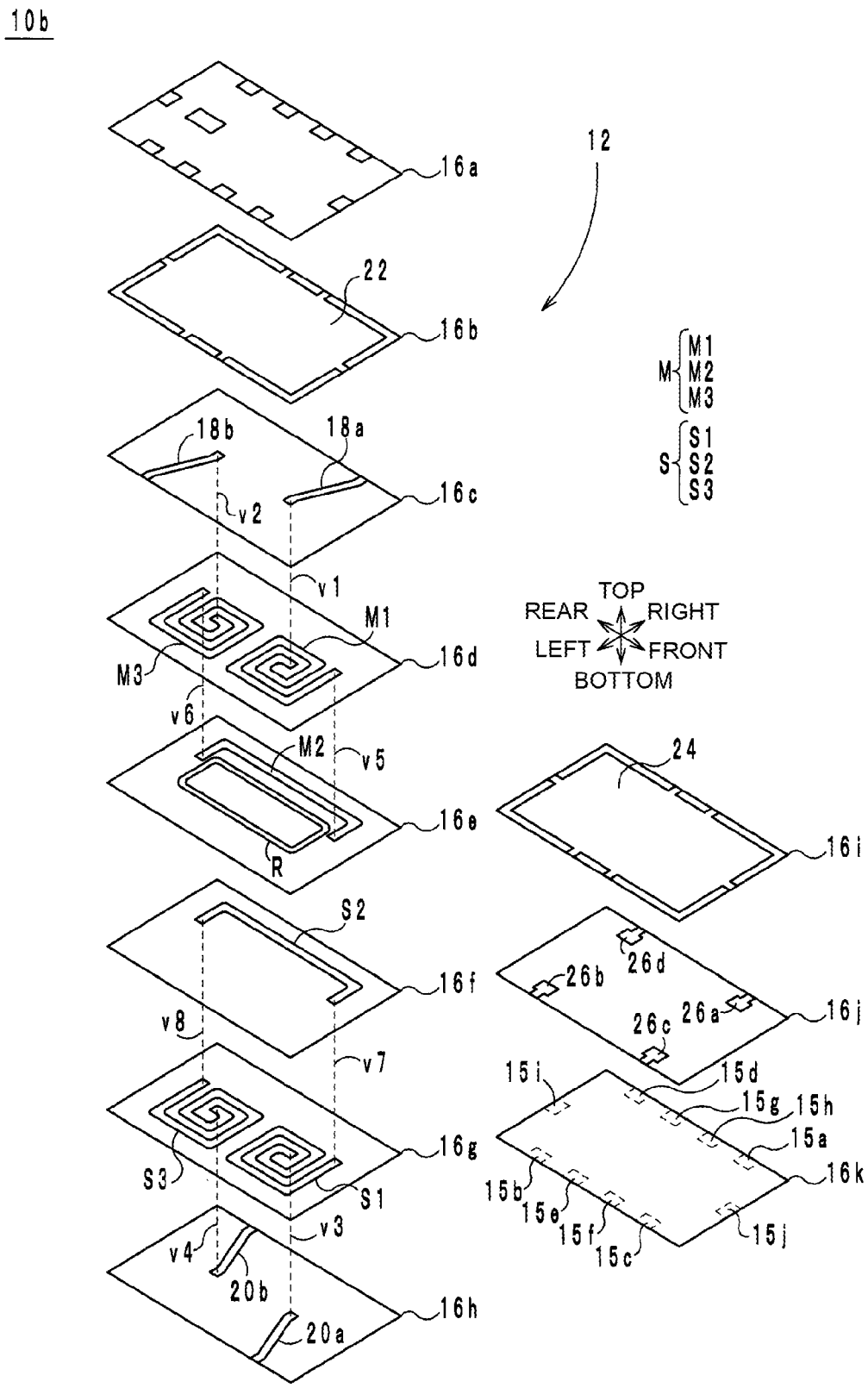
FIG. 5 is an exploded perspective view of a multilayer body of a directional coupler according to a second embodiment.

A directional coupler 10*b* according to a second embodiment will be described below with reference to FIG. 5. FIG. 5 is an exploded perspective view of a multilayer body 12 of the directional coupler 10*b*. As the external perspective view of the directional coupler 10*b*, FIG. 2 will be used.

The directional coupler 10*b* is different from the directional coupler 10*a* in that the intermediate line portion M2 is located at a different position from that of the main line portions M1 and M3 in the top-bottom direction and in that the intermediate line portion S2 is located at a different position from that of the sub line portions S1 and S3 in the top-bottom direction. More specifically, the main line portions M1 and M3 are disposed on the front side of the dielectric layer 16*d*, while the intermediate line portion M2 is disposed on the front side of the dielectric layer 16*e*. The sub line portions S1 and S3 are disposed on the front side of the dielectric layer 16*g*, while the intermediate line portion S2 is disposed on the front side of the dielectric layer 16*f*.

A via-hole conductor v5 passes through the dielectric layer 16*d* in the top-bottom direction and connects the downstream end of the main line portion M1 and the front end portion of the intermediate line portion M2. A via-hole conductor v6 passes through the dielectric layer 16*d* in the top-bottom direction and connects the upstream end of the main line portion M3 and the rear end portion of the intermediate line portion M2.

A via-hole conductor v7 passes through the dielectric layer 16*f* in the top-bottom direction and connects the downstream end of the sub line portion S1 and the front end portion of the intermediate line portion S2. A via-hole conductor v8 passes through the dielectric layer 16*f* in the top-bottom direction and connects the upstream end of the sub line portion S3 and the rear end portion of the intermediate line portion S2.

The ring conductor R is disposed on the front side of the dielectric layer 16*e*.

By the use of the directional coupler 10*b* configured as described above, advantages similar to those of the directional coupler 10*a* can be obtained.

Third Embodiment

Figure 6:
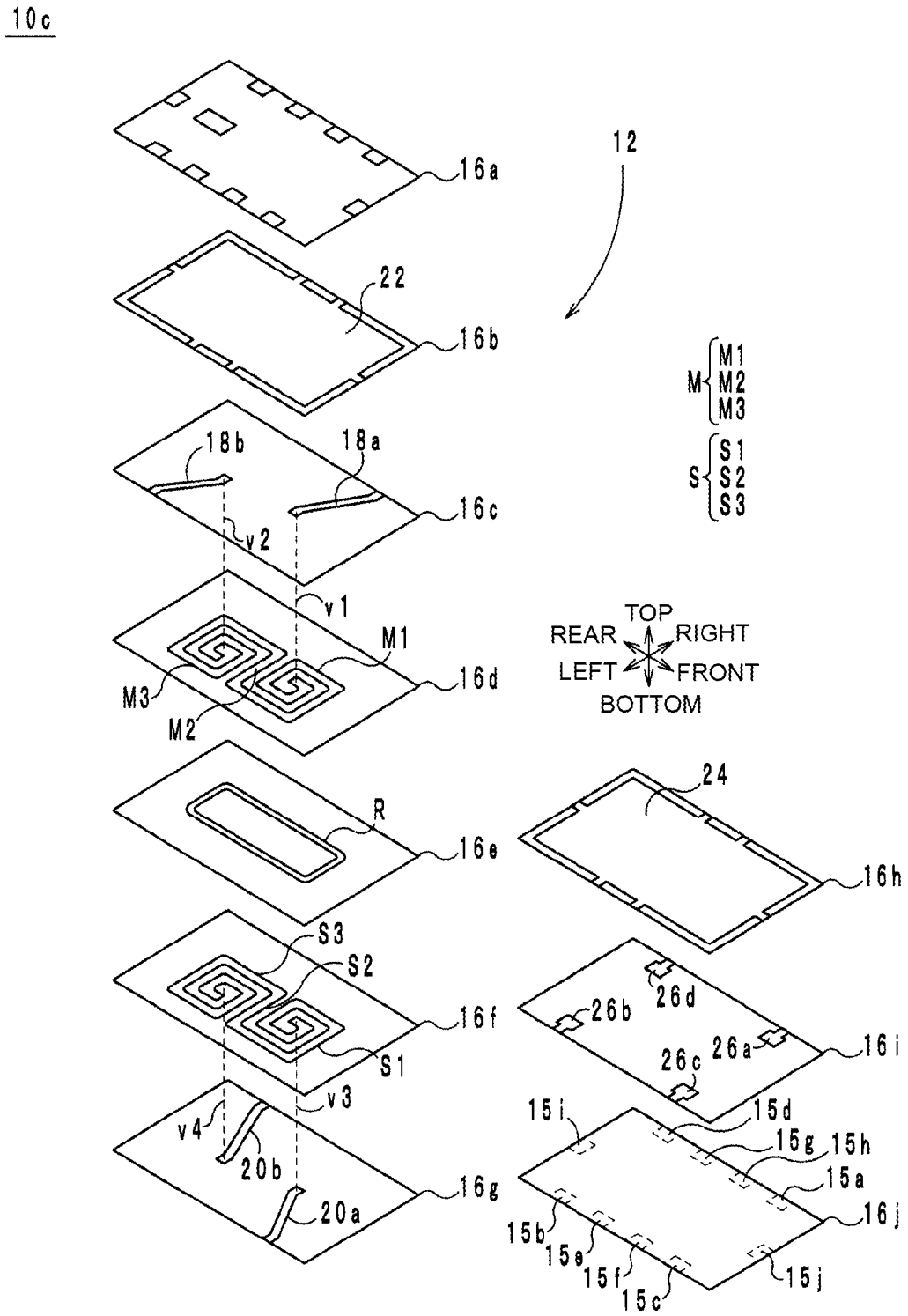
FIG. 6 is an exploded perspective view of a multilayer body of a directional coupler according to a third embodiment.

A directional coupler 10*c* according to a third embodiment will be described below with reference to FIG. 6. FIG. 6 is an exploded perspective view of a multilayer body 12 of the directional coupler 10*c*. As the external perspective view of the directional coupler 10*c*, FIG. 2 will be used.

The directional coupler 10*c* is different from the directional coupler 10*a* in the winding direction of the main line portion M1 and the sub line portion S1. In the directional coupler 10*a*, the main line portion M1 and the sub line portion S1 are formed in a spiral shape moving farther away from the center point while winding around the center point counterclockwise. In contrast, in the directional coupler 10*c*, the main line portion M1 and the sub line portion S1 are formed in a spiral shape moving farther away from the center point while winding around the center point clockwise.

By the use of the directional coupler 10*c* configured as described above, advantages similar to those of the directional coupler 10*a* can be obtained.

Fourth Embodiment

Figure 7:
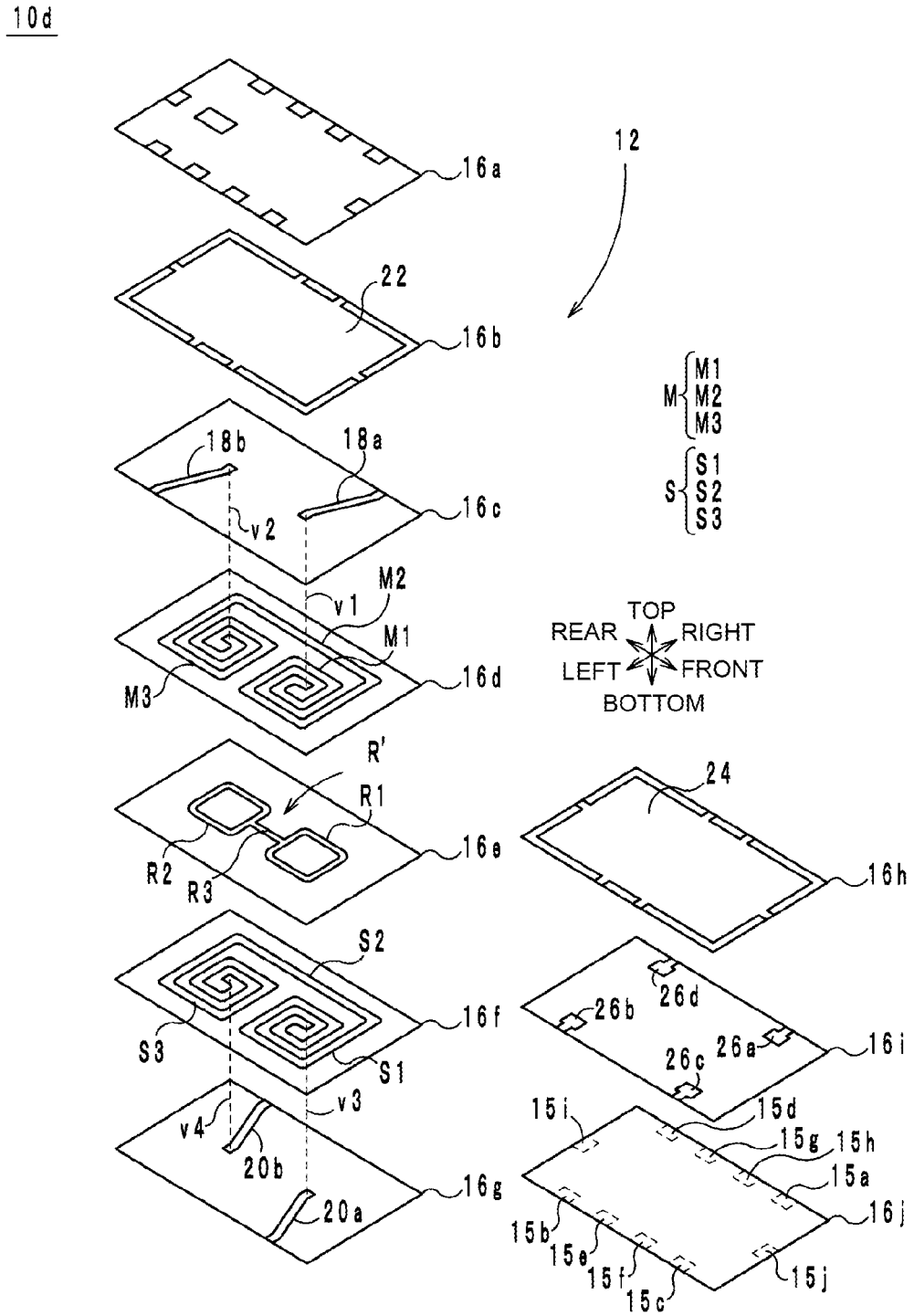
FIG. 7 is an exploded perspective view of a multilayer body of a directional coupler according to a fourth embodiment.

A directional coupler 10*d* according to a fourth embodiment will be described below with reference to FIG. 7. FIG. 7 is an exploded perspective view of a multilayer body 12 of the directional coupler 10*d*. As the external perspective view of the directional coupler 10*d*, FIG. 2 will be used.

The directional coupler 10*d* is different from the directional coupler 10*a* in the configuration of a ring conductor R'. The ring conductor R' will be discussed more specifically. The ring conductor R' includes ring-like portions R1 and R2 and a connecting portion R3 which are integrally formed. The ring-like portion R1 is a conductor layer formed substantially in a square ring and is disposed on the front half of the front side of the dielectric layer 16*e*. The ring-like portion R2 is a conductor layer formed substantially in a square ring and is disposed on the rear half of the front side of the dielectric layer 16*e*. The connecting portion R3 is a conductor layer connecting the ring-like portions R1 and R2 and is disposed on the front side of the dielectric layer 16*e*.

The center of the main line portion M1 and the center of the sub line portion S1 are located within a region surrounded by the ring-like portion R1, as viewed from above. The center of the main line portion M3 and the center of the sub line portion S3 are located within a region surrounded by the ring-like portion R2, as viewed from above.

By the use of the directional coupler 10*d* configured as described above, advantages similar to those of the directional coupler 10*a* can be obtained.

Fifth Embodiment

Figure 8:
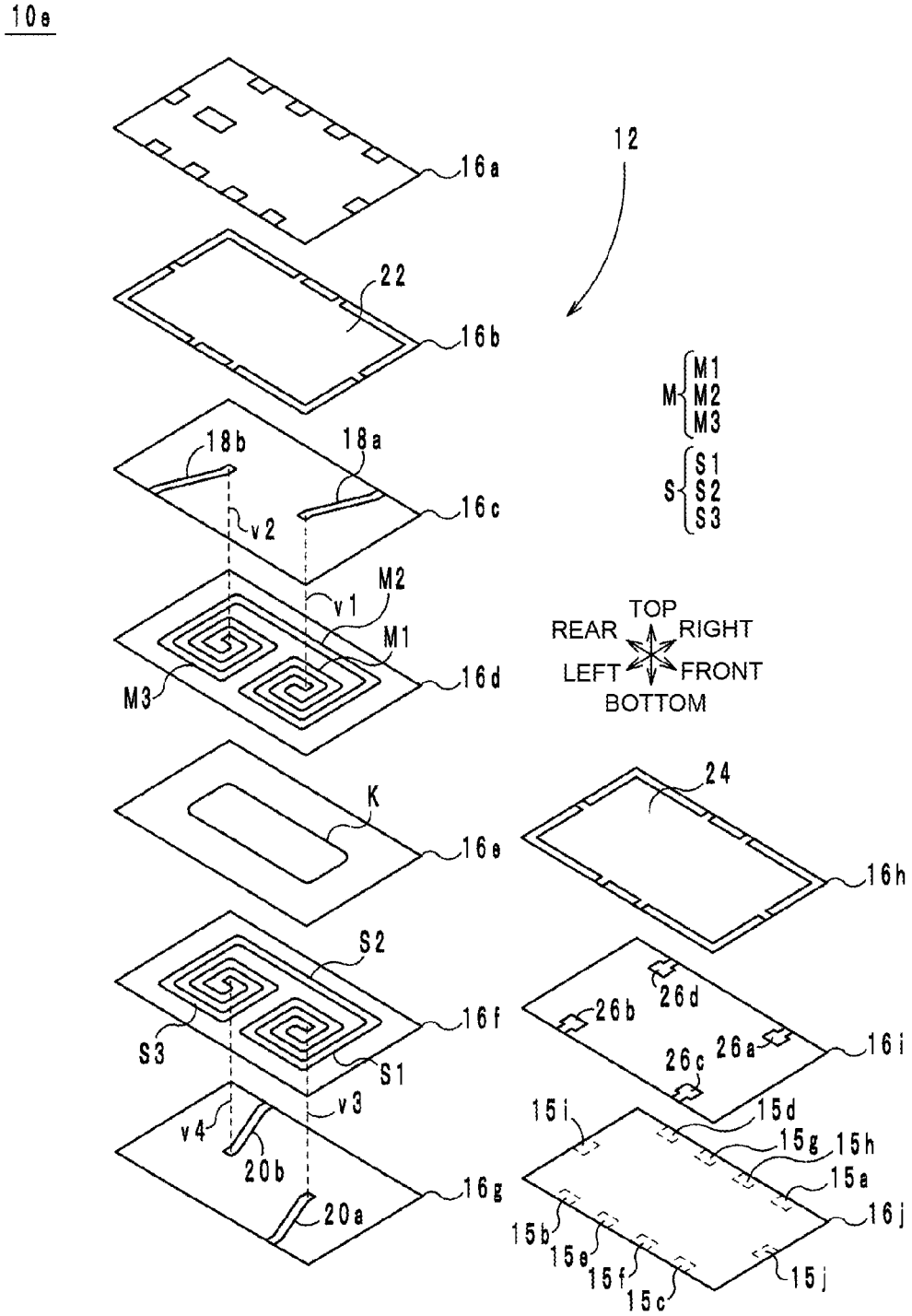
FIG. 8 is an exploded perspective view of a multilayer body of a directional coupler according to a fifth embodiment.

A directional coupler 10*e* according to a fifth embodiment will be described below with reference to FIG. 8. FIG. 8 is an exploded perspective view of a multilayer body 12 of the directional coupler 10*e*. As the external perspective view of the directional coupler 10*e*, FIG. 2 will be used.

The directional coupler 10*e* is different from the directional coupler 10*a* in that a coupling conductor K is used instead of the ring conductor R. The coupling conductor K will be described more specifically. The coupling conductor K is a conductor layer formed substantially in a rectangular shape and is disposed on the front side of the dielectric layer 16*e*. The coupling conductor K is superposed on the main line portions M1 and M3 and the sub line portions S1 and S3, as viewed from above.

By the use of the directional coupler 10*e* configured as described above, advantages similar to those of the directional coupler 10*a* can be obtained.

Other Embodiments

The present disclosure is not restricted to the directional couplers 10*a* through 10*e* of the first through fifth embodiments, and modifications may be made within the spirit of the disclosure.

The configurations of the directional couplers 10*a* through 10*e* may be combined with each other.

In the directional coupler 10*b* of the second embodiment, the intermediate line portions M2 and S2 may be located at the same position in the top-bottom direction. That is, the intermediate line portions M2 and S2 may be located on the same dielectric layer. In this case, as viewed from above, the intermediate line portions M2 and S2 are displaced from each other, instead of being superposed on each other as in the directional coupler 10*d*.

In the directional coupler 10*b* of the second embodiment, the position in the front-rear direction and/or the position in the right-left direction of the intermediate line portion M2 or S2 on the insulating layer may be changed so as to adjust the distance between the intermediate line portion M2 and the intermediate line portion S2. As a result, fine-adjustments may be made to the degree of coupling between the main line M and the sub line S.

In the directional couplers 10*a* through 10*e*, the width of the intermediate line portion M2 and that of the intermediate line portion S2 may be different from each other. Similarly, the width of the main line portion M1 and that of the sub line portion S1 may be different from each other, and the width of the main line portion M3 and that of the sub line portion S3 may be different from each other. In this manner, by changing the widths of the main line portions M1 and M3 and the intermediate line portion M2 and the widths of the sub line portions S1 and S3 and the intermediate line portion S2, the characteristic impedance of the main line M and that of the sub line S can be adjusted.

In the directional couplers 10*a* through 10*e*, it is preferable that the portions of the outer electrodes 14*a* through 14*d* bent to the bottom surface (hereinafter such portions will be referred to as "bent portions 15*a* through 15*d*" (see FIG. 3)) be smaller than the capacitor conductors 26*a* through 26*d* and be respectively contained within the capacitor conductors 26*a* through 26*d* (not extend to the outside of the capacitor conductors 26*a* through 26*d*), as viewed from above. With this arrangement, it is possible to suppress the formation of an unwanted capacitor between the bent portions 15*a* through 15*d* and the ground conductor 24.

The main line portions M1 and M3 may be disposed on different dielectric layers.

The sub line portions S1 and S3 may be disposed on different dielectric layers.

The configuration of the main line portion M1 and that of the sub line portion S1 may be different from each other. The configuration of the intermediate line portion M2 and that of the intermediate line portion S2 may be different from each other. The configuration of the main line portion M3 and that of the sub line portion S3 may be different from each other.

In the directional couplers 10*a* through 10*e*, the ring conductor R and the coupling conductor K may be superposed only on the main line portion M1 and the sub line portion S3, as viewed from above. That is, it is not always necessary that the ring conductor R and the coupling conductor K be superposed on the main line portion M3 and the sub line portion S1, as viewed from above. Alternatively, the ring conductor R and the coupling conductor K may be superposed only on the main line portion M3 and the sub line portion S1, as viewed from above. That is, it is not always necessary that the ring conductor R and the coupling conductor K be superposed on the main line portion M1 and the sub line portion S3, as viewed from above.

In the directional couplers 10*a* through 10*e*, the position of the main line portion M3 and the position of the sub line portion S3 may be swapped. In the directional coupler 10*a*, for example, the sub line portion S1 and the main line portion M3 may be disposed on the front side of the dielectric layer 16*f*, while the main line portion M1 and the sub line portion S3 may be disposed on the front side of the dielectric layer 16*d*. In this case, the ring conductor R may be disposed on a lower level than the sub line portion S1 and the main line portion M3 or on a higher level than the main line portion M1 and the sub line portion S3.

As described above, preferred embodiments of the present disclosure are suitably used for a directional coupler, and are particularly useful in that it is possible to increase the degree of coupling between a main line and a sub line of a directional coupler.

While preferred embodiments of the disclosure have been described above, it is to be understood that variations and modifications will be apparent to those skilled in the art without departing from the scope and spirit of the disclosure. The scope of the invention, therefore, is to be determined solely by the following claims.

What is claimed is:

1. A directional coupler comprising:

a main line including first and second main line portions formed substantially in a spiral shape, as viewed from a first direction, the second main line portion being positioned in a second direction which is perpendicular to the first direction, as viewed from the first direction;

a sub line including first and second sub line portions formed substantially in a spiral shape, as viewed from the first direction, the first and second sub line portions being electromagnetically coupled with the first and second main line portions, respectively, the second sub line portion being positioned in the second direction, as viewed from the first direction; and a parasitic element that is superposed on the first main line portion and the second sub line portion, as viewed from the first direction.

2. The directional coupler according to claim 1, wherein the parasitic element is superposed on the first and second main line portions and the first and second sub line portions, as viewed from the first direction.

3. The directional coupler according to claim 2, wherein:

the parasitic element is formed substantially in a ring-like shape, as viewed from the first direction; and a center of the first main line portion, a center of the second main line portion, a center of the first sub line portion, and a center of the second sub line portion are located within a region surrounded by the parasitic element, as viewed from the first direction.

4. The directional coupler according to claim 2, wherein:

the parasitic element includes first and second ring-like portions formed substantially in a ring-like shape, as viewed from the first direction, and a connecting portion connecting the first and second ring-like portions;

a center of the first main line portion and a center of the first sub line portion are located within a region surrounded by the first ring-like portion, as viewed from the first direction; and a center of the second main line portion and a center of the second sub line portion are located within a region surrounded by the second ring-like portion, as viewed from the first direction.

5. The directional coupler according to claim 1, wherein:

the first sub line portion is positioned at one side of the first direction;

the second sub line portion is positioned at one side of the first direction; and the parasitic element is positioned between the first main line portion and the first sub line portion and between the second main line portion and the second sub line portion in the first direction.

6. The directional coupler according to claim 1, wherein the parasitic element includes a plurality of components which are integrally formed.

7. The directional coupler according to claim 1, wherein:

the second main line portion is positioned adjacent to the first main line portion in the second direction; and the second sub line portion is positioned adjacent to the first sub line portion in the second direction.

8. The directional coupler according to claim 5, wherein:

the first sub line portion is positioned at one side of the first direction and the first main line portion is positioned at the other side of the first direction; and the second sub line portion is positioned at one side of the first direction and the second main line portion is positioned at the other side of the first direction.

9. The directional coupler according to claim 2, wherein:

the first sub line portion is positioned at one side of the first direction;

the second sub line portion is positioned at one side of the first direction; and the parasitic element is positioned between the first main line portion and the first sub line portion and between the second main line portion and the second sub line portion in the first direction.

10. The directional coupler according to claim 3, wherein:

the first sub line portion is positioned at one side of the first direction;

the second sub line portion is positioned at one side of the first direction; and the parasitic element is positioned between the first main line portion and the first sub line portion and between the second main line portion and the second sub line portion in the first direction.

11. The directional coupler according to claim 4, wherein:

the first sub line portion is positioned at one side of the first direction;

the second sub line portion is positioned at one side of the first direction; and the parasitic element is positioned between the first main line portion and the first sub line portion and between the second main line portion and the second sub line portion in the first direction.

12. The directional coupler according to claim 2, wherein the parasitic element includes a plurality of components which are integrally formed.

13. The directional coupler according to claim 3, wherein the parasitic element includes a plurality of components which are integrally formed.

14. The directional coupler according to claim 4, wherein the parasitic element includes a plurality of components which are integrally formed.

* * * * *